US005645269A

United States Patent [19]

Peterson

[11] Patent Number: 5,645,269

[45] Date of Patent: Jul. 8, 1997

[54] SHEAVE CABLE GUARDING AND GUIDING DEVICE

[75] Inventor: John A. Peterson, Brigham City, Utah

[73] Assignee: Wireline Technologies, Woods Cross, Utah

[21] Appl. No.: 482,026

[22] Filed: Jun. 7, 1995

[51] Int. Cl.[6] ..... B66D 1/00

[52] U.S. Cl. ..... 254/398; 254/393

[58] Field of Search ..... 254/335, 336, 254/394, 398, 411, 415, 389

[56] References Cited

U.S. PATENT DOCUMENTS

| | | | |
|---|---|---|---|
| 775,118 | 11/1904 | Rollston | 254/411 |
| 1,175,883 | 3/1916 | Feingold | 254/398 |
| 1,242,636 | 10/1917 | Ankrom | 254/411 |
| 1,379,868 | 5/1921 | Kelsey | 254/411 |
| 2,329,529 | 9/1943 | Gwinn | 254/389 |
| 2,347,885 | 5/1944 | Crickmer | 254/389 |
| 2,363,353 | 11/1944 | Parker | 254/411 |
| 3,215,405 | 11/1965 | Walsh | 254/389 |
| 4,480,818 | 11/1984 | Frank | 254/411 |

FOREIGN PATENT DOCUMENTS

| | | | |
|---|---|---|---|
| 673003 | 10/1963 | Canada | 254/389 |

*Primary Examiner*—Katherine Matecki
*Attorney, Agent, or Firm*—A. Ray Osburn

[57] ABSTRACT

A safety device for cable sheave installations, which provides cable guide assemblies which block hands and the like from being drawn in to be injured between moving cables and sheave wheels. The cable guide assemblies are pivotally attached to the outside ends of arms in turn pivoted at their inside ends from the sheave wheel support structure. The cable guides also prevent injury and property damage from cable jump, by guiding cables with large approaching fleet angles directly onto the wheels.

24 Claims, 6 Drawing Sheets

SHEAVE CABLE GUARDING AND GUIDING DEVICE

BACKGROUND OF THE INVENTION

1. Field

The field of the invention is guides and guards for cables directed by sheaves employed in the drilling and servicing of oil and gas wells.

2. State of the Art

In the drilling and servicing of oil and gas wells, apparatus is often lowered and raised by cables operating within boreholes extending deeply into the earth. Cables typically run from a winch through one or more sheaves changing the direction of the cable, ultimately directing it downwardly into the borehole.

Two principal problems, both addressed by the present invention, are associated with deployment and retrieval of cable in the boreholes. The cables run in the vicinity of workmen, whose hands or other body appendages are too often seriously injured when caught between the moving cables and rotating sheave wheels. In other cases the cable is drawn out of the cable guiding groove provided about the circumference of the sheave wheel. This "jumping of the sheave" is very dangerous to operating personnel, and is destructive to the sheave structure. The running cable may quickly abrade through the sheave structure, releasing the cable to whip violently and dangerously out of control. The cable is in danger of jumping the sheave when it can approach the sheave not directly, but only at a substantial angle to the plane of the sheave wheel called a "fleet angle".

One common operation is the retrieval of data from deep within boreholes. An instrument("sonde") is connected to an armored cable containing electrical conductors. The data measured by the sonde is sent up the conductors to the surface to be recorded and analyzed. The conductive cable is called a "wireline" in the industry, and the measurement of data from the borehole is called "wireline operations". In a typical wireline operation, the cable is deployed from a winch cable reel through a first rigging sheave located on the drilling rig floor. This sheave is called the floor sheave, and the line goes upward from it to a second sheave suspended from a block on or near the center of the top of the drilling derrick. This sheave is called the top sheave, and the line descends from it downwardly into the borehole.

Safety hazard in this instance occurs at the floor sheave, which the cable runs through at about knee height. Drilling rig floors typically have poor and uncertain footing, being covered with oil, drilling mud, water and other well fluids, and frequently ice. A slipping workman reflexively reaches for support, often grasping the moving cable, which carries his hand into the sheave to be pinched between the running line and the rotating sheave wheel. Hands, arms, legs or clothing may be also ensnared and carried by the moving line into its confluence with the sheave wheel.

On offshore oil platforms, the sheaves used for routine drilling and well service operations are frequently attached to the deck of the platform. Lines of differing sizes are used for various necessary functions in proximity to workmen. The number of sizes of running lines enhances the danger of limb and clothing entrapment.

Sizeable fleet angles are more likely to develop on sheaves fastened to decks or bulkheads rather than on those suspended overhead on swivels. Although the swivel mount in theory causes the sheave wheel to become aligned with the plane of the approaching and departing cable, sizeable fleet angles are in practice still developed because of the complications of friction, and other imperfections in the swiveling process. The fleet angle problem, then, occurs both with swivel suspended sheaves as well as with floor or bulkhead mounted sheaves.

The prior art discloses attempts to block the entry of hands or clothing from entering the sheave assembly to be pinched between the cable and the wheel, and to guide the cable sufficiently to prevent cable jump from the sheave. U.S. Pat. Nos. 775,118 and 1,242,656 each disclose a pair of cable guiding arms pivoted from sheave wheel mounting bodies or housings. Each pair of arms at its end distant from the housing joins with a fixed integral guiding loop. The cable engaging loop, being integral with the pivoted arm, restricts the usable angle of the cable guide. This can only be countered by enlarged guiding loop size, impairing its guiding and guarding performance. Accordingly, these cable guides are inherently useful only within limited ranges of cable position and angle of approach to the sheave wheel. In the disclosed embodiments, this limitation is countered by providing guide arms of excessive length, less effectively guarding against digit or limb entrapment between the sheave and the cable. When enlarged guiding loop sizes are employed, the guiding is so impaired that cable jump may often still be a danger.

The fixed integral relationship between the guiding loops and pivoting arms, the length of the arms, the point of pivotal attachment to the housing, and the play allowed the cable within the loops, all must be selected to provide the best combination. The guiding and guarding performance is necessarily compromised to achieve a balance between these competing factors. The same disadvantage is also disclosed in U.S. Pat. No. 1,379,868, wherein the arms are brackets fixedly secured to the housing, from which cable guide sleeves are pivoted. This allows for no adjustment of position of the guide sleeves during operation. Some lateral guiding flexibility is provided by the use of very loose pivotal connections. No automatic adjustment of guide sleeve position is possible. The brackets must be positioned to accommodate specific angles of approach of the cable to the sheave assembly.

U.S. Pat. No. 1,365,951 discloses a combination of a fixed cord guide and a pivoted arm carrying such a guide. Again, the guiding element is fixedly secured to the arm. Similar disclosures are found in U.S. Pat. Nos. 346,084, 349,520 and 126,391. The latter two are adapted for chain sheaves, but nevertheless disclose pivoting arms with fixed guide elements at each end.

None of the devices disclose embodiments capable of sufficiently versatile application to provide efficient, dependable guiding and guarding of oil and gas well wireline cables.

BRIEF SUMMARY OF THE INVENTION

The present invention eliminates or substantially alleviates the shortcomings and disadvantages of present guarding and guiding devices for sheave cables. The inventive device comprises a pair of cable guide assemblies, disposed about the cable at its entry and exit to the sheave assembly. Each guide assembly is pivotally secured to the outer end of an arm assembly, which is in turn pivoted at its other end from the sheave wheel supporting structure. The guide and arm assembly pivot axes are parallel, and both are perpendicular to the plane of the sheave wheel. Each assembly carries a through bore, loosely but closely accepting the cable and oriented to pivot always within the plane of the sheave wheel as the guide and arm assemblies pivot during operation of the device.

In operation, the arm pivots to place the guide assembly at the cable, to there itself pivot to align the bore with the cable. The cable is guided by the bore into the plane of the sheave, and the guide assembly effectively prevents limbs or objects from being drawn with the cable into the sheave wheel.

The pivot attachment points of the arms to the sheave wheel housing may be selected to accommodate particular shapes of housings. The two arm assemblies need not necessarily be pivoted coaxially from the sheave housing. However, many sheave and housing designs may be accommodated by pivoting both arm assemblies coaxially with the sheave wheel, the pivoting guide assemblies not theoretically required but compensating for variations in sheave and cable diameter and arm length.

Advantageously, each arm assembly comprises a pair of side members extending on opposite sides of the sheave supporting structure. The guide assembly preferably comprises a pivot block assembly spanning between the outside ends of the side members. The block assembly comprises at least two separable parts. The cable guiding bore is split among the parts, so that the bore is opened upon separation of the parts, and so that the block may be installed around the cable from the side without access to the cable ends, with the cable passing through the reassembled circular bore. In one preferred embodiment, one of the block portions spans between the side members, and has an internally threaded central perforation in the plane of the sheave wheel. A similarly oriented cable mounting slot opens from the threaded perforation through one side of the block portion, so that it may be placed about the cable. The cable guiding bore is provided extending axially through an externally threaded bushing which mates with the internal threads in the integral block portion. The bushing is split into halves along a plane through the axis of the cable guiding bore, so that the bushing may be assembled with the cable through the bore. Mating dowel pins and bores in the two halves of the bushing permit assembly with the split thread closely aligned.

It is therefore a principal object of the invention to provide a cable guard device preventing worker injuries at the junction of moving cables and rotating sheaves. Another principal object is to provide a guide which eliminates the peril of excessive fleet angles causing cable jumping.

BRIEF DESCRIPTION OF THE DRAWINGS

In the drawings, which represent the best modes presently contemplated for carrying out the invention.

DETAILED DESCRIPTION OF ILLUSTRATED EMBODIMENTS

Figures 1, 3:
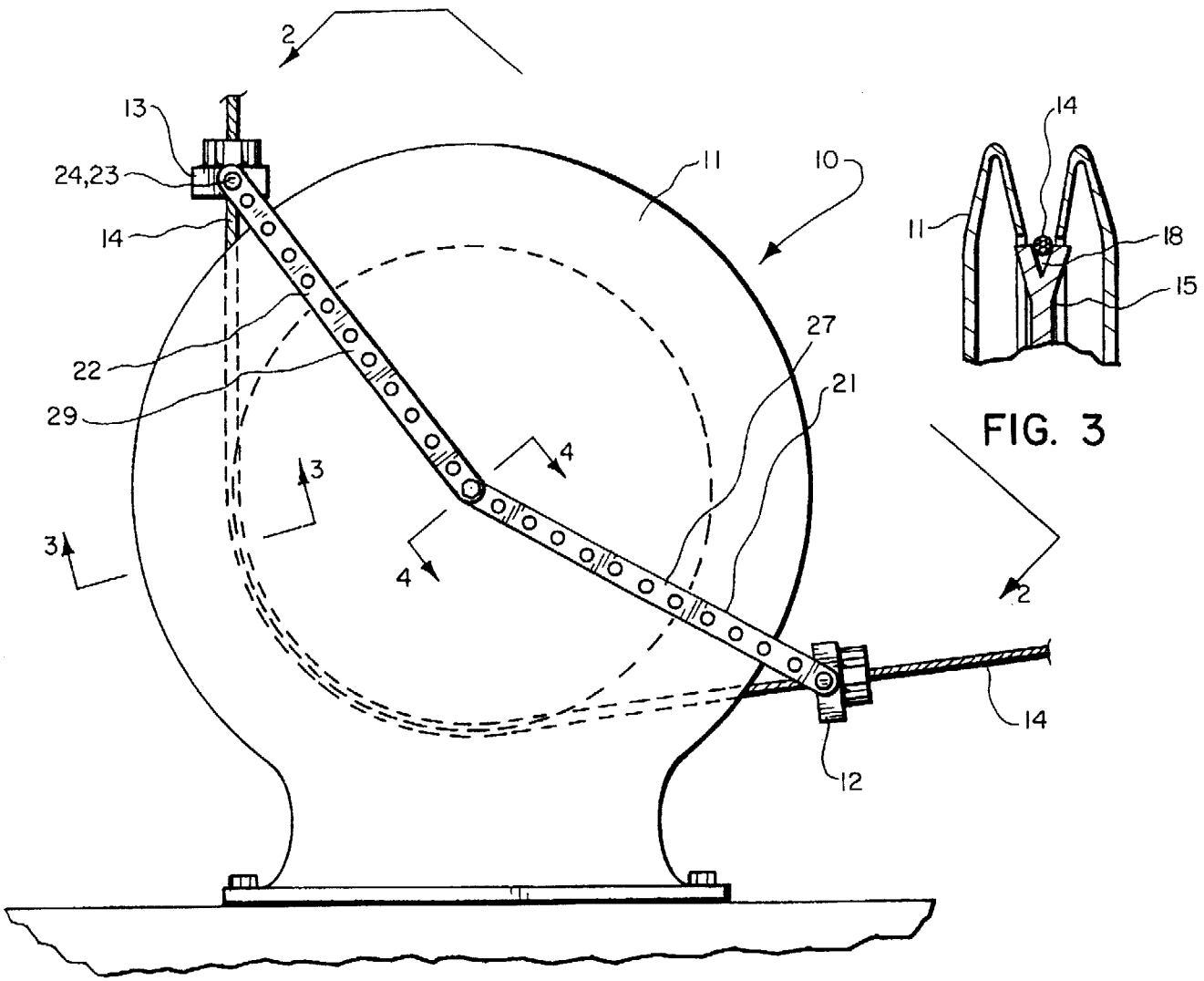
FIG. 1 is a side elevation view of a cable guarding and guiding device in accordance with the invention illustrated in use upon a typical floor mounted sheave assembly, drawn to a reduced scale, FIG. 2 a view of the device of FIG. 1 taken along line 2—2 thereof, drawn to the same scale, FIG. 3 a cross sectional view of a fragment of the sheave assembly of FIG. 1 line 3—3 thereof, drawn to substantially the same scale, FIG. 4 a cross sectional view of a fragment of the sheave assembly and attached cable guarding and guiding device of FIG. 2, showing the common axis of rotation thereof, taken along line 4—4 of FIG. 2, drawn to substantially full scale, FIG. 5 a perspective view of a fragment of the device of FIG. 1, showing one of the guiding block assemblies thereof, drawn to substantially full scale, FIG. 6 a perspective view of the split, threaded, removable bushing assembly of FIG. 5, drawn to substantially the same scale, FIG. 7 a side elevation view of the split, threaded, removable bushing of FIG. 6, drawn to the same scale, FIG. 8 an end elevation view of the bushing of FIG. 7, taken along line 8—8 thereof, cut away to show one of the alignment dowel pins thereof, drawn to the same scale, FIG. 9 an elevation view of one of the halves of the split bushing, taken along line 9—9 of FIG. 8, drawn to the same scale, FIG. 10 a left front perspective view of the block of the assembly of FIG. 5, showing the internally threaded bore therethrough and the cable installation slot, drawn to substantially full scale, FIG. 11 a cross sectional view of a fragment of the block assembly of FIG. 5, taken along line 11—11 thereof, drawn to substantially full scale, FIG. 12 a perspective view of one of the side members of the arm assemblies of the device of FIG. 1, drawn to substantially reduced scale, FIG. 13 a schematic representation of an alternate embodiment of the cable guarding and guiding device wherein the arms of a pair of guide block assemblies are pivoted about a common axis distant from the sheave wheel axis, drawn to a reduced scale, FIG. 14 a schematic representation of a cable guiding and guarding device wherein the arms of a pair of guiding block assemblies are pivoted from different locations upon the sheave housing, drawn to the scale of FIG. 13, FIG. 15 a schematic side elevation view of alternate embodiment of the cable guarding and guiding device, wherein the guiding block assemblies are positioned along a pair of opposing slots in parallel plates secured to the sheave housing, drawn to approximately one-half scale, FIG. 16 a side view of a fragment of the guarding and guiding device of FIG. 15, drawn to the same scale, FIG. 17 a view of the cable guarding and guiding device of FIG. 16 taken along line 17—17 thereof, drawn to the same scale, and FIG. 18 an exploded view of an alternate embodiment of the guiding block assembly, drawn to substantially full scale.
Figure 2:
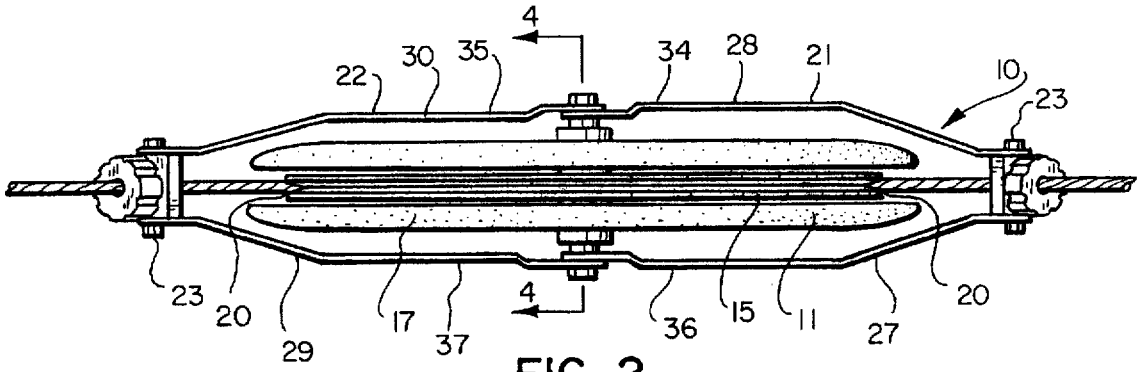

A cable guide and guard assembly 10 is illustrated in FIG. 1 installed upon a typical floor mounted sheave assembly 11. Identically constructed cable guide assemblies 12 and 13 engage cable 14 as it enters and exits the sheave assembly respectively. Sheave wheel 15 rotates about an axle 16 journaled to rotate within sheave housing 17. Cable 14 is guided by a groove 18 provided about the circumference of wheel 15. As seen best in FIG. 2, cable 14 is guided into the plane of sheave wheel 15 through a bore 19 in each cable guide assembly. This precludes the cable from jumping from groove 18. Guide assembly 12 also prevents cable 14 from drawing workers' hands or clothing into the juncture 20 of sheave wheel 15 and cable 14.

The cable guide assemblies are supported by arm assemblies 21 and 22, respectively, connected pivotally by pairs of aligned axle stubs 23 oriented parallel to sheave wheel axle 16. In this embodiment, the axle stubs each comprise unthreaded outstanding stem portions 26 of a shoulder bolt 24 installed within a threaded bore 25.

Figure 4:
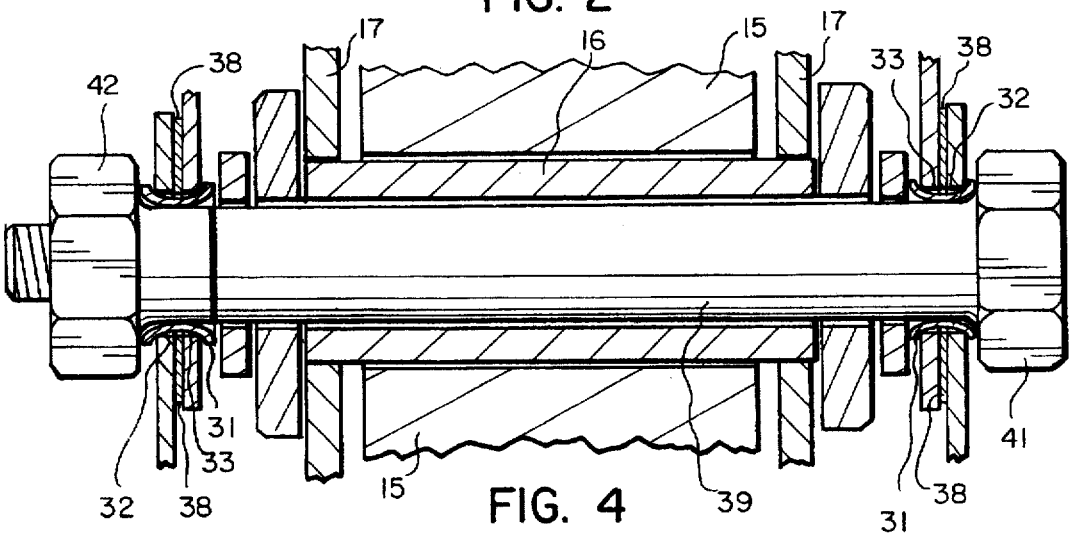
Figure 5:
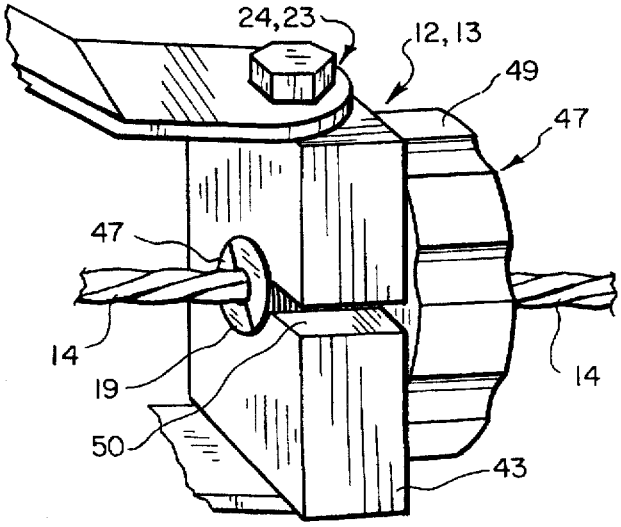
Figure 6:
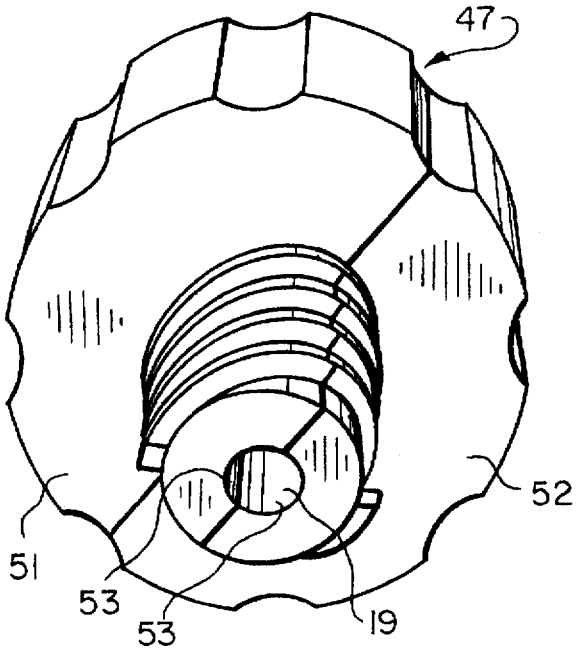
Figure 7:
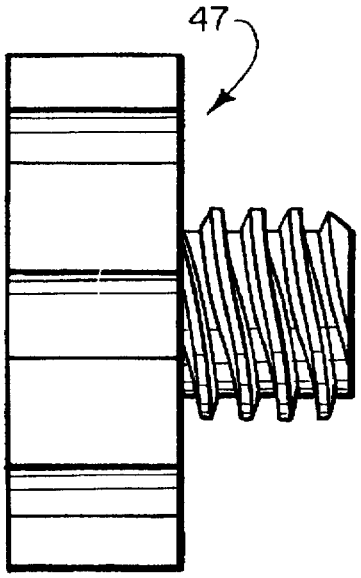
Figure 8:
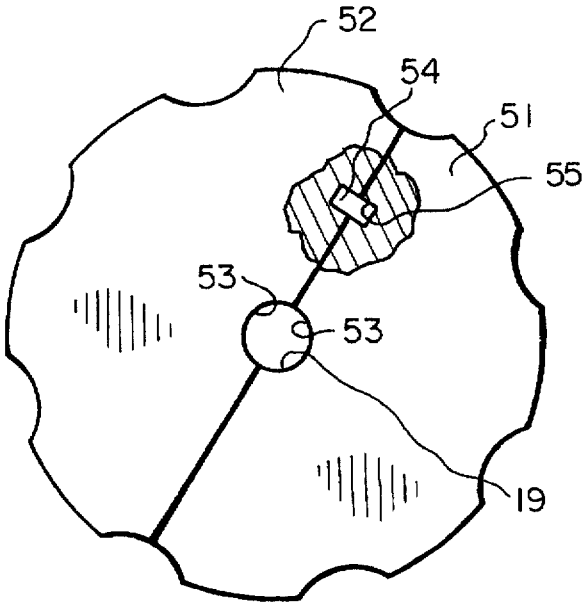
Figure 9:
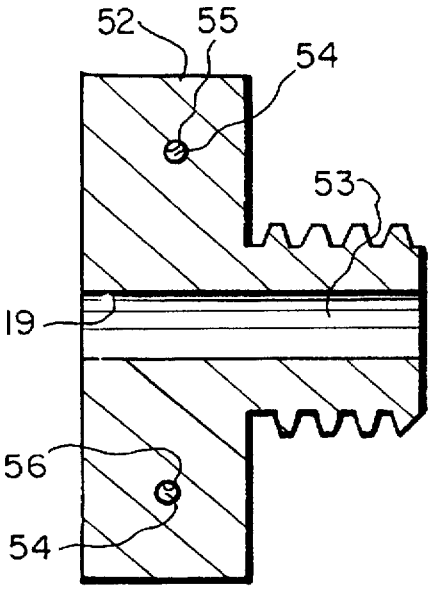
Figure 10:
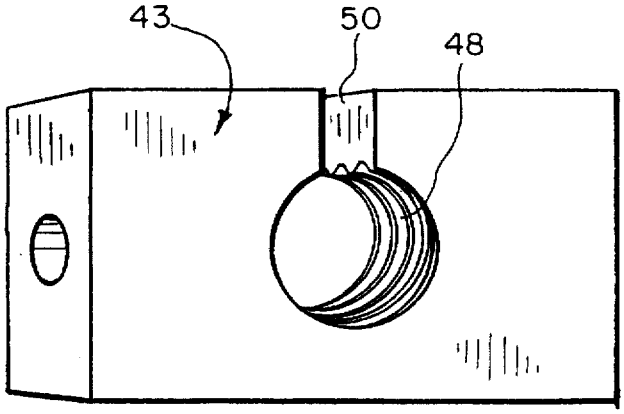
Figure 11:
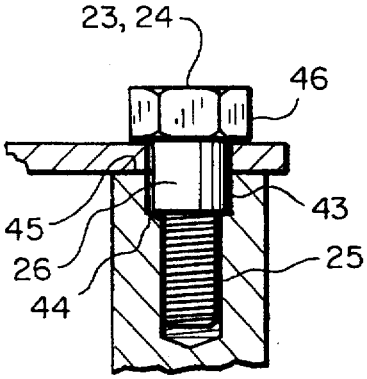
Figure 12:
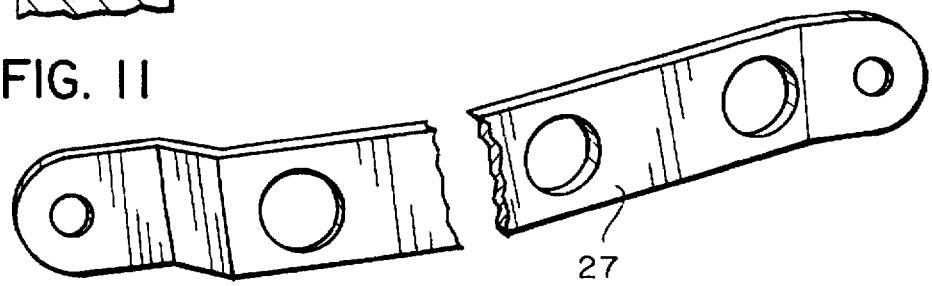

Arm assemblies 12 and 13 comprise pairs of side members 27,28 and 29,30 respectively. The side members are in this illustrated embodiment pivotally secured together at the axle 16 of the sheave wheel 15 by end flared sleeves 31 installed loosely fitting within aligned bores 32 and 33 through joining side members 27,29 and 28,30. Each side member is advantageously shaped to provide end portions parallel to the plane of sheave wheel 15, both at sheave axle 16 and at each guard assembly 12 and 13. Side member end portions of pair 27, 28 are offset inwardly, and those of pair 29, 30 outwardly, to interface in line with connecting side member sections 34,36 and 35,37 respectively. (FIG. 2) Interface washer 38 prevents direct, potentially binding, frictional contact between the pivoting ends. (FIGS. 4 and 5) Axle pin 39 extends through hollow sheave axle 16, securing both arm assemblies pivotally to sheave assembly 11 coaxially with sheave wheel 15. Axle pin 39 preferably comprises a contoured head 41 to mate with the outside flared end of the adjacent sleeve 31. Shaped retaining nut 42 similarly engages the other of the sleeves 31. With this arrangement, each arm assembly pivots independently of both the sheave housing and the other arm assembly.

Each of the cable guide assemblies 12 and 13 includes a pivoting block 43 spanning and securing the outside ends of the side members of each arm assembly together through shoulder bolts 24. The pairs of aligned shoulder bolts 24 secure the block 43 pivotally to the side members of each of the arm assemblies 21 and 22, along a line perpendicular to sheave wheel 15. Each shoulder bolt bore 25 has a counterbore 43 sized to closely accept the unthreaded stem portion 26 of the associated shoulder bolt. Shoulder 44 bottoms, leaving sufficient space between end 45 of block 43 and bolt head 46 to allow free rotation of the joining side member. Thus, the cable guide assemblies 12 and 13 readily pivot to guide cable 14 during operation.

As best seen in FIG. 5–9, the cable guiding bore 19 axially pierces externally threaded bushing 47, which is installed within an internally threaded perforation 48 through pivoting block 43. Perforation 48 is oriented so that its longitudinal axis is within the plane of sheave wheel 15. Externally threaded bushings 47 advantageously carries an enlarged gripping knob 49 to facilitate installation. When bushing 47 is installed within the threaded perforation 48 of block 43, the axis of cable guiding bore 19 lies within the plane of sheave wheel 15.

For installation of guard assemblies 12 and 13 upon cable 15, the threaded perforation 48 of block 43 is opened laterally by a cable installation slot 50 aligned with the plane of the sheave wheel. With bushing 47 removed, block 43 is placed around the cable, using slot 50. bushing 47 is split into matching halves 51 and 52, each containing a semicircular groove 53. (FIGS. 5–9) For installation, the halves are separated and bushing 47 reassembled about cable 14, the grooves 53 matching to provide the cylindrical cable guiding bore 19. Expanding dowel pins 54 join aligned blind bores 55 and 56 to closely align the grooves 53 and the severed halves of the external threads 57. Bushing 47, thus installed around cable 14, is then threaded into block 43 to complete the installation of each guard 12 and 13. Advantageously, sets of two or three parallel threads are employed within block 43 and upon bushing 47, the threads having quite steep pitch, permitting very rapid installation.

Preferably, block 43 and bushing 47 are advantageously constructed of a Nylon composition with additives such as molybdenum disulfide and graphite, providing high abrasion resistance and inherent lubricity, to minimize wear on both guide bore and cable, which for wireline operations incorporates signal and ground leads.

Figure 13:
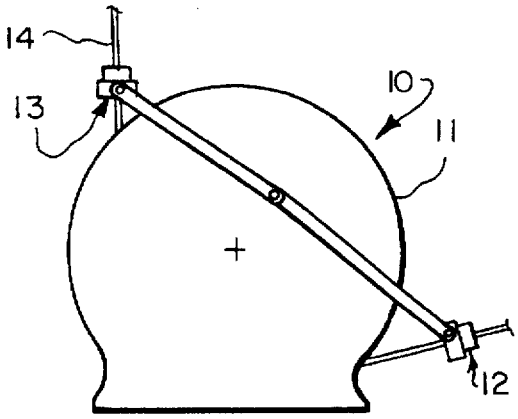
Figure 14:
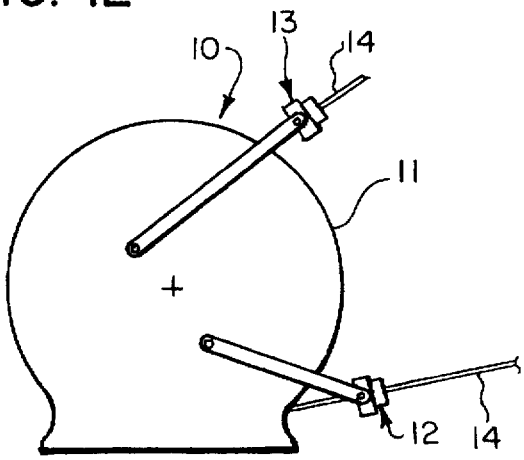

Further embodiments than those specifically illustrated are within the spirit of the invention. For example, although it is advantageous, the arm assemblies 21 and 22 need not be pivoted from a common point upon sheave housing 17. Separate attachment locations may permit more advantageous placement of the guide assemblies 12 and 13 for variously shaped sheave housings 17. For similar reasons, nor is either of the arm assemblies necessarily pivotally attached coaxially with sheave wheel 15. (FIGS. 13 and 14)

Figure 15:
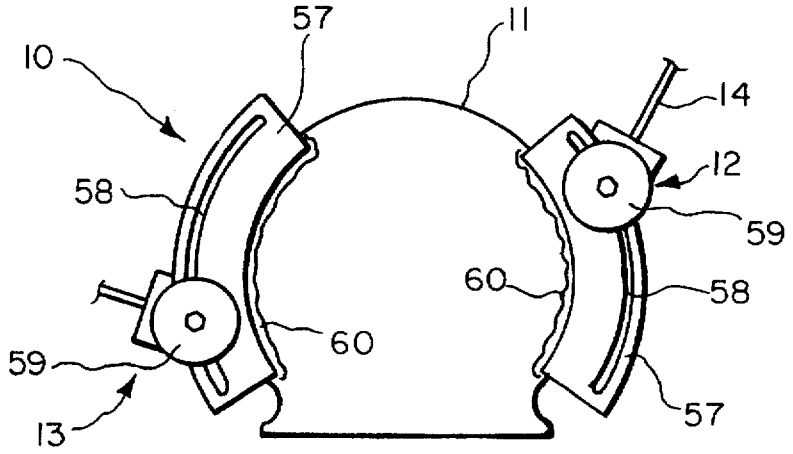
Figure 16:
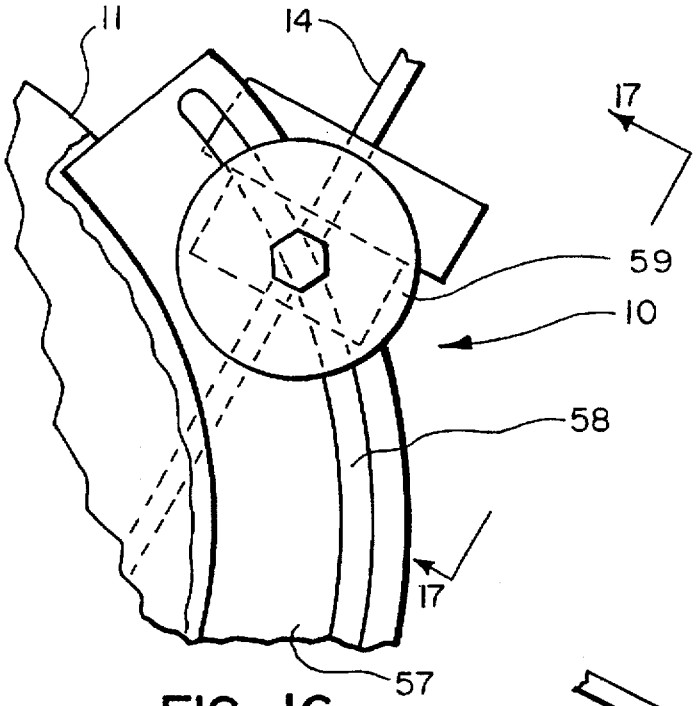
Figure 17:
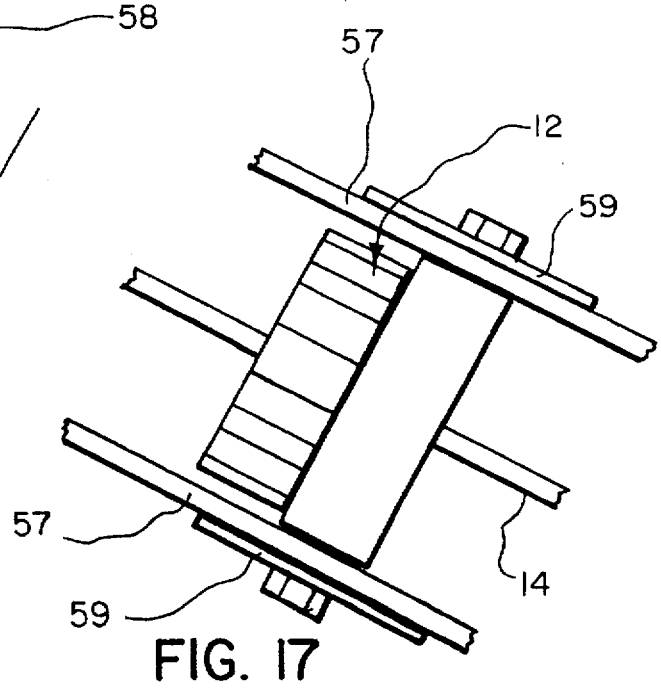

The cable guide assemblies may be differently mounted than as illustrated from the ends of pivoting arm assemblies. For example, a pair of parallel, spaced apart, cable guard mounting plates 57 could be affixed to the outside of the sheave housing 17. (FIGS. 15–17) A pair of parallel guide slots 58 in the plates 57 accept shoulder bolt stub axles 24, so that the guard assemblies 12 and 13 may be moved along the slots as required by cable 14. To preclude excessive guide assembly canting from cables having pronounced fleet angles, large diameter "outrigger" washers 59 may be fixedly attached as by welds 60 to shoulder bolts 24. Advantageously, rotating bearings, not shown, could be provided about stems 26 of shoulder bolts 24, to act within guide slots 58.

Figure 18:
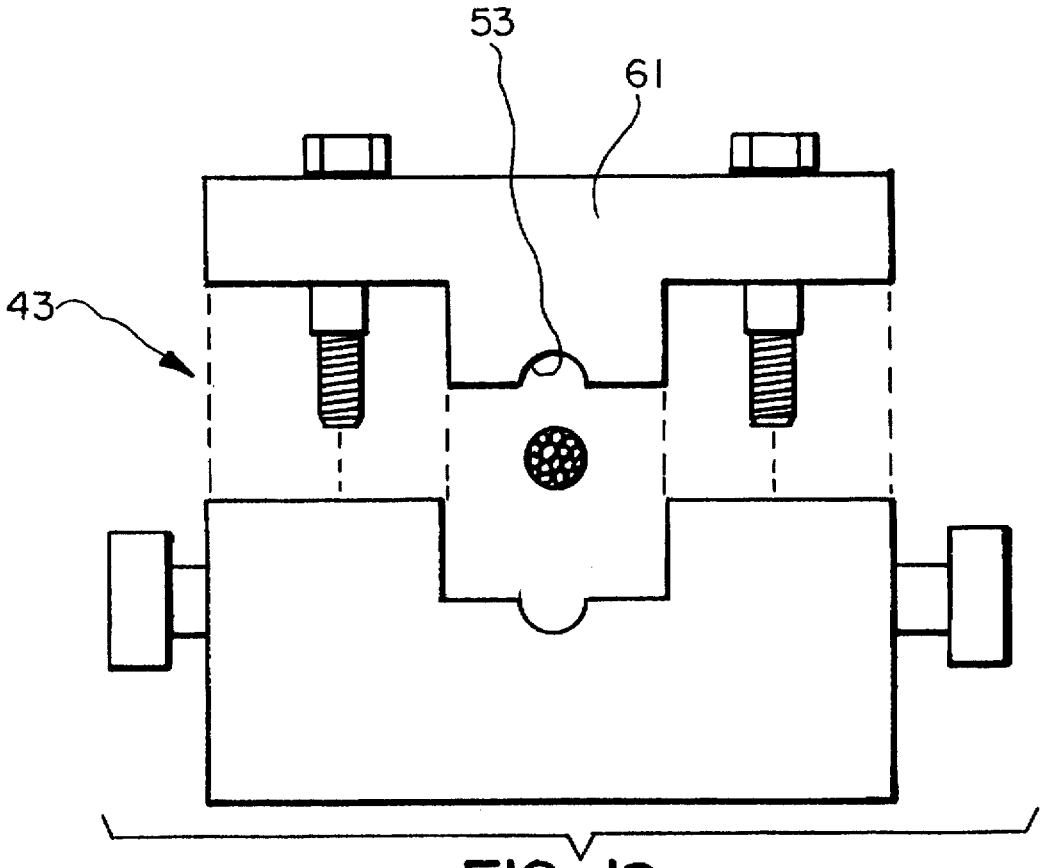

Other designs could be employed to allow installation of the guide assemblies upon the cable from the side without access to either of its ends. One such design is indicated in FIG. 18, providing a removable portion 61 of pivoting block 43 having the groove 53. Other embodiments (not illustrated) could employ two or more removable portions so that bore 19 would be split into three or more grooves upon dis-assembly.

The invention may be embodied in still other specific forms without departing from the spirit or essential characteristics thereof. The present embodiments are, therefore, to be considered as illustrative and not restrictive, the scope of the invention being indicated by the appended claims rather than by the foregoing description, and all changes that come within the meaning and range of equivalency of the claims are, therefore, intended to be embraced therein.

What is claimed and desired to be secured by United States Letters Patent is:

1. A cable guarding and guiding device for use upon a sheave assembly, said sheave assembly including a cable engaging sheave wheel mounted to rotate about a fixed axis upon a supporting structure, said guarding and guiding device comprising:

a body assembly carrying a cable engaging and guiding bore therethrough coplanar with the sheave wheel;

means mounting the body assembly upon the supporting structure freely movable to cable engaging locations; and axle means securing the body assembly to the mounting means to rotate, without contact with said sheave assembly, about an axis perpendicular to the plane of the sheave wheel and also perpendicular to the plane of the cable engaging and guiding bore.

2. The device of claim 1, wherein:

the body assembly includes means permitting installation upon a cable from a side of the cable without access to either end of said cable.

3. The device of claim 2, wherein the body assembly comprises:

a first portion being integral and carrying the axle means;

at least one additional portion being removably secured to the axle means carrying portion, selected ones among said first portion and said additional portions each carrying an arcuate groove being a portion of the cable engaging and guiding bore not greater than one half thereof; so that the removably secured portions may be detached from the body assembly and subsequently replaced thereon with the cable engaged by the cable engaging and guiding bore, the grooves having joined to form said bore.

4. The device of claim 3, wherein:

the axle means carrying portion is selected to carry one of the arcuate grooves.

5. The device of claim 4, wherein the body assembly mounting means comprises:

an elongate arm assembly having an inside and an outside end, its inside end pivotally secured to the housing about an axis perpendicular to the plane of the sheave wheel, the body assembly being pivotally secured to the outside end by the axle means.

6. The device of claim 5, wherein the arm assembly comprises:

a pair of side members extending on opposite sides of the sheave housing.

7. The device of claim 6, wherein:

the cable guiding and guarding device comprises a pair of said devices, one guiding the cable entering the sheave assembly and the other the cable exiting said assembly.

8. The device of claim 7, wherein:

the arm assemblies of the cable guiding devices are pivotally secured at their inside ends about a common axis.

9. The device of claim 8, wherein:

the common pivot axis of the arms coincides with the axis of rotation of the sheave wheel.

10. The device of claim 3, wherein:

the axle carrying portion of the body assembly has a perforation therethrough aligned with the plane of the sheave wheel;

the removably secured portions comprise a bushing secured within said perforation; wherein the bushing carries the cable engaging guiding bore; and the bushing comprises at least two separable parts, each having an arcuate groove being a portion of the cable engaging guiding bore no greater than one half thereof.

11. The device of claim 10, wherein:

the body assembly perforation is circular and carries internal threads;

the bushing has a circular portion carrying external threads, said portion joining with the threads within the perforation.

12. The device of claim 11, wherein the body assembly mounting means comprises:

an elongate arm assembly having an inside and an outside end, its inside end pivotally secured to the housing about an axis perpendicular to the plane of the sheave wheel, the body assembly being pivotally secured to the outside end by the axle means.

13. The device of claim 12, wherein the arm assembly comprises:

a pair of side members extending on opposite sides of the sheave housing.

14. The device of claim 13, wherein:

the cable guiding and guarding device comprises a pair of said devices, one guiding the cable entering the sheave assembly and the other the cable exiting said assembly.

15. The device of claim 14, wherein:

the arm assemblies of the cable guiding devices are pivotally secured at their inside ends about a common axis.

16. The device of claim 15, wherein:

the common pivot axis of the arms coincides with the axis of rotation of the sheave wheel.

17. The device of claim 10, wherein the body assembly mounting means comprises:

an elongate arm assembly having an inside and an outside end, its inside end pivotally secured to the housing about an axis perpendicular to the plane of the sheave wheel, the body assembly being pivotally secured to the outside end by the axle means.

18. The device of claim 17, wherein the arm assembly comprises:

a pair of side members extending on opposite sides of the sheave housing.

19. The device of claim 18, wherein:

the cable guiding and guarding device comprises a pair of said devices, one guiding the cable entering the sheave assembly and the other the cable exiting said assembly.

20. The device of claim 19, wherein:

the arm assemblies of the cable guiding devices are pivotally secured at their inside ends about a common axis.

21. The device of claim 20, wherein:

the common pivot axis of the arms coincides with the axis of rotation of the sheave wheel.

22. The device of claim 10, wherein the body assembly mounting means comprises track means secured to the housing, said track means comprising:

a pair of parallel plates spaced apart to accept the body assembly therebetween, each plate being parallel to, equidistant from, and on opposite sides of, the plane of the sheave wheel, and each plate carrying a slot, the slots being everywhere parallel and directly opposed, and sized to accept the body assembly axle means; so that the body assembly may be installed between the plates with the axle means engaging the slots, and moved along the slots to cable engaging positions.

23. The device of claim 3, wherein the body assembly mounting means comprises:

an elongate arm assembly having its inside end pivotally secured to the housing about an axis perpendicular to the sheave wheel, the body assembly being pivotally secured to the outside end by the axle means.

24. The device of claim 3, wherein the body assembly mounting means comprises:

track means secured to the housing, guiding the body assembly through the axle means carried by said body assembly.

* * * * *